United States Patent [19]

Marshall

[11] 3,993,571

[45] Nov. 23, 1976

[54] SPIN FINISH FOR YARN USED IN FOOD PACKAGING

[75] Inventor: Robert Moore Marshall, Chester, Va.

[73] Assignee: Allied Chemical Corporation, Morris Township, N.J.

[22] Filed: Apr. 11, 1975

[21] Appl. No.: 567,150

[52] U.S. Cl. ..... 252/8.9; 106/243

[51] Int. Cl.[2] ..... D06M 5/10

[58] Field of Search ..... 106/243, 211; 260/347.4; 252/8.9, 6, 8.8; 428/395

[56] References Cited

UNITED STATES PATENTS

| | | | |
|---|---|---|---|
| 2,695,270 | 11/1954 | Jefferson | 252/8.9 |
| 3,248,258 | 4/1966 | Coats | 428/395 |
| 3,428,560 | 2/1969 | Olsen | 252/8.9 |
| 3,781,202 | 12/1973 | Marshall | 252/8.9 |
| 3,888,775 | 6/1975 | Kolzumi | 252/8.9 |

*Primary Examiner*—Theodore Morris

*Attorney, Agent, or Firm*—Fred L. Kelly

[57] ABSTRACT

This invention relates to a yarn finishing composition and more specifically to a spin finish for multifilament yarns used in food packaging. The preferred finishing composition comprises butyl stearate, sorbitan monooleate and polyoxyethylene (20) sorbitan monooleate.

4 Claims, No Drawings

SPIN FINISH FOR YARN USED IN FOOD PACKAGING

BACKGROUND OF THE INVENTION

This invention is directed to a synthetic multifilament yarn containing a novel finishing composition, and more specifically to a spin finish for multifilament yarn used in food packaging. Still more specifically, this invention is directed to a finishing composition comprising butyl stearate, sorbitan monooleate and polyoxyethylene (18–22) sorbitan monooleate, for multifilamentary yarns made from synthetic linear polymers including, for example, polyamides, polyesters, polyolefins, and other polymers useful in food packaging.

In the manufacture of yarn filaments including, for example, filaments made from linear polymers such as the polyesters and polyamides, the ultimate strength of the yarn can be substantially improved by subjecting the filaments to drawing techniques to increase their molecular orientation. Although the drawing operation may be conducted by various means, the common procedure comprises devices commonly known as feed and draw rolls for advancing the filaments. The filaments are stretched by running the rolls at differential speeds with the degree of drawing depending upon the ratio of the peripheral speeds of said rolls. In order to localize the point at which the stretching or drawing occurs, a draw point localizer is normally used. For example, a device may be placed between the feed and draw roll which is known as a draw pin around which the yarn is wrapped. This pin introduces a frictional drive on the moving filaments which causes drawing to take place in areas of the pin. It is well known that the drawing operation can be facilitated when the temperature of the yarn is elevated. The application of heat may be accomplished by various means, e.g., a hot plate placed between the feed and draw rolls.

One of the problems encountered during drawing, either at ambient or elevated temperatures is the frequent occurrence of filament breakage. Thus, during drawing, one or more of the individual filaments of the thread line may break and wrap around the draw rolls or the entire thread line may break which requires stoppage until adjustments can be made. One of the causes of filament breakage during the drawing process is the buildup of an extensive amount of tension on the yarn, which is due for the most part to the interfilamentary friction and yarn-to-metal friction. Excessive tensions resulting from the development of high frictions during the drawing can be reduced, however, by applying to the yarn various antifriction compositions. These compositions are generally applied via an aqueous medium prior to drawing. Although there are presently available various finishing compositions which may be used to reduce yarn tension buildup during drawing, there is a need for compositions capable of not only lowering the yarn to metal friction, but also consisting of ingredients suitable for use on yarn to be used in food packaging, where all ingredients must be approved by the Food and Drug Administration (FDA) for use as direct or indirect food additives.

SUMMARY OF THE INVENTION

In accordance with the present invention, I provide a spin finish composition for yarn used in food packaging, wherein all ingredients have been cleared by the FDA for general use as direct or indirect food additives. A further object of this invention is to provide a spin finish composition which is readily emulsifiable in water, has excellent stability to conventional yarn processing conditions, provides lubrication, static protection, and plasticity to the yarn for subsequent drawing and other high temperature processing.

The spin finish composition of the present invention consists essentially of about 45 to 55 weight percent of said composition of a compound selected from the group consisting of butyl stearate and coconut oil; about 14 to 22 weight percent of said composition of sorbitan monooleate; and about 27 to 37 weight percent of said composition of ethoxylated sorbitan monooleate, said ethoxylated sorbitan monooleate being ethoxylated with about 18 to 22 moles of ethylene oxide.

DESCRIPTION OF THE PREFERRED EMBODIMENT

The preferred spin finish composition of the present invention consists essentially of about 47 to 53 weight percent of said composition of a compound selected from the group consisting of butyl stearate and coconut oil; about 16 to 20 weight percent of said composition of sorbitan monooleate; and about 30 to 34 weight percent of said composition of ethoxylated sorbitan monooleate, said ethoxylated sorbitan monooleate being ethoxylated with about 20 mols of ethylene oxide.

In applying the finishing composition of this invention to the filaments, e.g., nylon, conventional methods may be employed. In general, good results are obtained in both hot and cold drawing operations when the finishing composition is applied in amounts ranging from about 0.2 to 1.5 percent and more preferably 0.8 to 1.0 percent by weight of the yarn. The finishing composition is desirably applied as an aqueous emulsion containing about 12 to 25 percent of the finishing composition. The finishing composition is applied to the yarn prior to drawing by conventional techniques which comprise, for example, bringing the yarn in contact with the composition while it moves during the course of production. The composition may be applied to the yarn by various methods and devices which may include use of a lubricating roll, wick, or having the yarn pass through a bath containing the finishing composition.

The following examples are provided to more fully illustrate the instant invention.

EXAMPLE 1

Table I shows the preferred finish composition of this invention.

TABLE I

| Finish Composition | Weight Percent |
|---|---|
| Butyl stearate | 50 |
| Sorbitan monooleate | 18 |
| Polyoxyethylene (20)[a] sorbitan monooleate | 32 |

[a]The ethoxylated sorbitan monooleate was ethoxylated with about 20 moles of ethylene oxide.

It was found that the butyl stearate of this preferred finish composition can be replaced in full or in part with an equal weight of coconut oil, which is more resistant to high temperatures that may occur during processing of some yarns. However, the finish containing butyl stearate is generally preferred because of its better lubricating properties.

EXAMPLE 2

The following example demonstrates use of the preferred spin finish of the present invention.

A polycaprolactam yarn (200 denier-32 filament) was prepared by conventional spin-draw techniques. Immediately after spinning, the spin finish consisting of 50 parts by weight of butyl stearate, 18 parts by weight of sorbitan monooleate and 32 parts by weight of sorbitan monooleate reacted with 20 moles of ethylene oxide was applied to the yarn at the rate of 0.85 weight percent based on the weight of the yarn. The spin finish was applied to the yarn as 14 weight percent emulsion in water, by means of a conventional kiss roll applicator. Drawing performance, beaming, and weaving properties of the yarn were excellent.

After drawing, the yarn was tested for frictional and static properties. Yarn to metal friction was about 165 grams, based on the tension generated by passing the yarn over a 0.25 inch chrome plated stainless steel pin at 1,000 feet per minute, said pin having a RMS of 2.0–2.2. Static generation was 30 millivolts, based on static generated by passing the yarn over a 0.25 inch chrome plated stainless steel pin at 200 feet per minute, said pin having a RMS of 4.0–4.5.

Fabric was prepared by conventional means from yarn prepared in accordance with this example. This fabric was folded and placed over the bone of freshly cut meat, which was then covered with a conventional plastic wrapping. The folded fabric prevented the bone from cutting the plastic wrap.

EXAMPLE 3

Table II shows the criticality of the ingredients of the spin finish composition as well as the amounts of ingredients necessary in order to provide a stable emulsion. Note that only the finishes identified as B and C provide excellent emulsion stability after 48 hours. Varying the components or the weight ratio of components of the finish resulted in significant changes in emulsion stability.

TABLE II

| Finish Ingredients | Finish Compositions Composition in Weight Percent A | B | C | D |
|---|---|---|---|---|
| Butyl stearate | 50 | 45 | 50 | 50 |
| Sorbitan monooleate | 25 | 20 | 18 | |
| Polyoxyethylene (20) sorbitan monooleate | 25 | 35 | 32 | 32 |
| Polyoxyethylene (20) sorbitan trioleate | | | | 18 |

TABLE II-continued

| Finish Ingredients | Finish Compositions Composition in Weight Percent A | B | C | D |
|---|---|---|---|---|
| Emulsion stability* after 48 hours | P | E | E | F |

*Stability of 16 percent emulsion prepared at 55° C. E = Excellent - Translucent bluish-white, particle size less than 1 micron. No separation. F = Fair - Milky white, particle size up to 4 microns. Slight ring of oil separation on surface. P = Poor - Chalky white, particle size above 4 microns. Creaming on surface.

EXAMPLE 4

The spin finish compositions of Example 3 were used to prepare polycaproamide yarns as described in Example 2, and the resulting yarns were tested for frictional and static properties as described in Example 2. Table III shows criticality of the amounts and the presence of various components; note particularly the relatively low yarn to metal friction of Yarn C.

TABLE III

| Finish Ingredients | Finish and Fiber Process Data Composition in Weight Percent A | B | C | D |
|---|---|---|---|---|
| Butyl stearate | 50 | 45 | 50 | 50 |
| Sorbitan monooleate | 25 | 20 | 18 | |
| Polyoxyethylene (20) sorbitan monooleate | 25 | 35 | 32 | 32 |
| Polyoxyethylene (20) sorbitan trioleate | | | | 18 |
| Fiber Process Data | | | | |
| Yarn to metal friction of yarn, g. | 188 | 196 | 165 | 170 |
| Static generation, millivolts | 50 | 20 | 30 | 40 |

Based on frictional properties and static properties shown in Table III, and the emulsion stability shown in Table II, Composition C is considered to be the preferred spin finish composition of the present invention.

I claim:

1. A spin finish composition for treating synthetic filamentary yarn used in food packaging consisting essentially of about 47 to 53 weight percent of said composition of a compound selected from the group consisting of butyl stearate and coconut oil; about 16 to 20 weight percent of said composition of sorbitan monooleate; and about 30 to 34 weight percent of said composition of ethoxylated sorbitan monooleate, said ethoxylated sorbitan monooleate being ethoxylated with about 20 moles of ethylene oxide.

2. The spin finish composition of claim 1 wherein the compound selected from the group consisting of butyl stearate and coconut oil is butyl stearate.

3. The spin finish composition of claim 1 wherein the compound selected from the group consisting of butyl stearate and coconut oil is coconut oil.

4. The spin finish composition of claim 1 as an aqueous emulsion.

* * * * *